US005836177A

United States Patent [19]

Okuno et al.

[11] Patent Number: 5,836,177

[45] Date of Patent: Nov. 17, 1998

[54] BINDING-OFF METHOD, BOUND KNITTED FABRIC, AND CAD APPARATUS THEREFOR

[75] Inventors: Masao Okuno, Wakayama, Japan; Michael Caird, Troon, Scotland

[73] Assignee: Shima Seiki Manufacturing Ltd., Wakayama, Japan

[21] Appl. No.: 774,786

[22] Filed: Dec. 30, 1996

[30] Foreign Application Priority Data

Dec. 28, 1995 [JP] Japan ..... 7-344229

[51] Int. Cl.[6] ..... D04B 1/24; D04B 7/10

[52] U.S. Cl. ..... 66/64; 66/176

[58] Field of Search ..... 66/64, 70, 196, 66/170, 172 R

[56] References Cited

U.S. PATENT DOCUMENTS

| | | | |
|---|---|---|---|
| 3,474,643 | 10/1969 | Robinson et al. | 66/70 |
| 3,668,901 | 6/1972 | Betts et al. | 66/176 |
| 3,824,810 | 7/1974 | Betts et al. | 66/176 X |
| 5,271,249 | 12/1993 | Mitsumoto et al. . | |
| 5,379,615 | 1/1995 | Shima | 66/176 |
| 5,456,096 | 10/1995 | Mitsumoto et al. | 66/172 R X |
| 5,537,843 | 7/1996 | Okuno | 66/64 |
| 5,584,197 | 12/1996 | Okuno | 66/64 |
| 5,669,244 | 9/1997 | Okuno | 66/64 |

*Primary Examiner*—John J. Calvert

*Attorney, Agent, or Firm*—Nikaido, Marmelstein, Murray & Oram LLP

[57] ABSTRACT

Each stitch of the last course of a front knitted fabric of a tubular knitted fabric is overlapped with a stitch, one stitch interior, of an immediately preceding course of the front knitted fabric. Each stitch of the last course of a back knitted fabric is overlapped with a stitch, one stitch interior, of an immediately preceding course of the back knitted fabric. Prolongations of each stitch of the last course of the front knitted fabric crosses with prolongations of a stitch of the last course of the back knitted fabric.

4 Claims, 12 Drawing Sheets

→ Knit Towards Right

← Carrier Movement

↑ Transfer

→ Knit Towards Right

↓ Transfer

↑ Transfer 13B
a b c d e f g h i j
B
15
18
↓ Transfer
F
A B C D E F G H I J
12C 13C 13B
a b c d e f g h i j
B
→ 2P
18
↑ Transfer
F
A B C D E F G H I J
13C 12C 18 15 a b c d e f g h i j
B
← 2P
↓ Transfer
F
A B C D E F G H I J
13C 12C 18 15,13B a b c d e f g h i j
B
11
19
← Knit Towards Left
F
A B C D E F G H I J
12C
13C 12C 18 a b c d e f g h i j
B
19
↑ Transfer
F
A B C D E F G H I J
12C
13C 18 a b c d e f g h i j
B
← 2P
19
↓ Transfer
F
A B C D E F G H I J
12D
12C

↑ Transfer

→ Knit Towards Right

↓ Transfer

← Knit Towards Left

↑ Transfer

↓ Transfer

→ Knit Towards Right

↑ Transfer

← Knit Towards Left

↓ Transfer

↑ Transfer

→ Knit Towards Right

↓ Transfer

← Knit Towards Left

↑ Transfer

↓ Transfer

Fig. 12

| | | | Knitting Conditions | |
|---|---|---|---|---|
| | | | X-1 | Y-1 |
| | | | ↓ Transfer from Rear to Front<br>○ Front Knit on Dual Stitch<br>↖ Transfer from Front to Rear with 2 Pitch Left Shift | ↑ Transfer from Front to Rear<br>○ Rear Knit on Dual Stitch<br>↓ Transfer from Rear to Front<br>↖ Transfer from Front to Rear with 2 Pitch Left Shift |
| Carrier Movement | L | 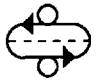 | Quality 4<br>Knitting Rank 5 | Quality 5<br>Knitting Rank 5 |
| | M | 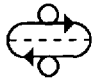 | Quality 4<br>Knitting Rank 5 | Quality 4<br>Knitting Rank 5 |
| | N | 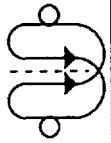 | Quality 4<br>Knitting Rank 5 | Quality 4<br>Knitting Rank 5 |

Fig. 13

| | | | Knitting Conditions | |
|---|---|---|---|---|
| | | | X-2 | Y-2 |
| | | | ○ Front Knit on Final Course<br>↓ Transfer from Rear to Front<br>○ Front Knit on Dual Stitch<br>↖ Transfer from Front to Rear with 2 Pitch Left Shift | ○ Front Knit on Final Course<br>↑ Transfer from Front to Rear<br>○ Rear Knit on Dual Stitch<br>↓ Transfer from Rear to Front<br>↖ Transfer from Front to Rear with 2 Pitch Left Shift |
| Carrier Movement | O | 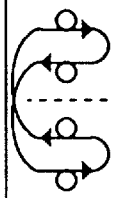 | Quality 4<br>Knitting Rank 4 | Quality 3<br>Knitting Rank 4 |
| | P | 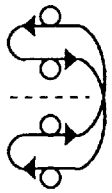 | Quality 3<br>Knitting Rank 4 | Quality 4<br>Knitting Rank 4 |
| | Q | 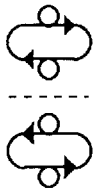 | Quality 4<br>Knitting Rank 3 | Quality 3<br>Knitting Rank 2 |

BINDING-OFF METHOD, BOUND KNITTED FABRIC, AND CAD APPARATUS THEREFOR

FIELD OF THE INVENTION

The present invention relates to using a flat knitting machine in which at least two needle beds having a large number of needles are arranged, one in the front and one in the rear, to oppose each other, joining knitted fabrics being knitted on the front and rear needle beds, and binding the joined knitted fabrics together. The present invention further relates to knitted fabrics thus bound and a CAD apparatus storing the binding-off method.

PRIOR ART

It has been proposed to knit knitted products such as sweater in the form of a tubular knitted fabric comprising a front body and a back body joined together. According to this method, both a right sleeve and a left sleeve are knitted simultaneously with both bodies. In a train of courses for joining the sleeves to the bodies, the sleeves are shifted towards the bodies to join the sleeves onto the bodies. After that, if necessary, a portion ranging from the shoulders to the neck will be knitted as a single tubular knitted fabric, and stitches of the front body and stitches of the back body will be joined together at the shoulders and be bound off. This eliminates needs of sewing operation after the completion of knitting. However, a knitted fabric thus knitted must meet such conditions as wearability that assures many times of wear, designedness for neat appearance, and being comfortable to wear. Thus a knitting method is required that meets these conditions. In particular, for such a knitting technique, it is necessary, for instance, to join a front body and a back body together at shoulders of a sweater and bind off. As such methods of binding, the applicant applied patents for Japanese Provisional Patent Publication HEI-4-209855 (U.S. Pat. No. 5,456,096) and Japanese Patent Application HEI-7-83695 (U.S. patent application Ser. No. 08/628,107). Here knitting of garments is taken as example, but needs for neat appearance of binding are not limited to garments.

According to U.S. Pat. No. 5,456,096, a front body and a back body are knitted by using a front needle bed and a rear needle bed. After that, a yarn feeder that was used in knitting the front body and a yarn feeder that was used in knitting the back body are used to repeatedly bind stitches of the front body and those of the rear body while a yarn from one fabric to a corresponding yarn feeder and the other yarn from the other fabric to the other corresponding yarn feeder are being kept crossed with each other. In a knitted fabric bound off by this knitting method, a front knitted fabric and a back knitted fabric are joined together by crossed yarns. Hence the bound portions will not protrude, and the bound portions will not get stiff.

According to U.S. patent application Ser. No. 08/628,107, when a stitch of a front knitted fabric and a stitch of a back knitted fabric are to be overlapped with each other, each stitch is transferred once onto a needle of an opposing needle bed. After that, any one stitch is transferred again to make one stitch overlap with the other stitch, then a new stitch is formed on the overlapping stitches. In this way, the bound portion is prevented from protruding.

SUMMARY OF THE INVENTION

The present invention is intended to provide binding that is capable of reliably joining knitted fabrics without generating any gap between the joined knitted fabrics and has an excellent appearance unknown to the prior art.

A binding-off method according to the present invention wherein a flat knitting machine having at least a pair of a front needle bed and a rear needle bed, each of said needle beds having a large number of needles, using a space between said at least a pair of needle beds as a trick gap, at least one of said needle beds being slidable to the right and to the left, and having at least a yarn feeder for feeding yarn to needles of needle beds is used to bind two knitted fabrics, front one and back one, and each knitted fabric is provided with a large number of stitches, each of said stitches consisting of a loop and prolongations on both sides thereof comprises repeating the following steps a, b and c from at least one side end of each of two knitted fabrics, front one and rear one, towards the interior portions of said two knitted fabrics:

a: forming new stitches in succession to stitches of the respective two knitted fabrics, front one and rear one;

b: transferring said new stitches to opposing needle beds to make the prolongations of said new stitches cross each other; and c: after that, overlapping said new stitches with interior stitches of said two knitted fabrics, front one and rear one.

A binding-off method according to the present invention wherein a flat knitting machine having at least a pair of a first needle bed and a second needle bed being arranged to oppose each other, one in the front and the other in the rear, each of said needle beds having a large number of needles, using a space between said first needle bed and said second needle bed as a trick gap, at least either said first needle bed or said second needle bed being slidable to the right and to the left, and having at least a yarn feeder for feeding yarn to needles of the first needle bed and the second needle bed is used to bind a first knitted fabric and a second knitted fabric, each of said knitted fabrics consisting of a large number of stitches, each stitch consisting of a loop and prolongations on both sides thereof, in each knitted fabric a large number of stitches are arranged in both a direction parallel to and a direction perpendicular to the needle beds, a row of stitches being parallel to the needle beds being defined as a course and a row of stitches being perpendicular to the needle beds being defined as a wale is characterized by the following processes:

(1) a process of forming at least a stitch (14) in succession to a stitch (12A) at one end of a binding area of a first knitted fabric (10*a*);

(2) a process of transferring the stitch (14) formed in the process (1) over the trick gap;

(3) a process of forming at least a stitch (15) in succession to a stitch (13A) at one end of a binding area of a second knitted fabric (10*b*);

(4) a process of transferring the stitch (15) formed in the process (3) over the trick gap in such a way that the stitch (15) will cross with the stitch (14);

(5) a process of overlapping a stitch (12B) of a wale interior to said stitch (12A) at one end of the first knitted fabric with the stitch (14);

(6) a process of forming a stitch (18) over the double stitches overlapped by the process (5);

(7) a process of transferring the stitch (18) formed by the process (6) over the trick gap in such a way that the stitch (18) will cross with the stitch (15);

(8) a process of overlapping a stitch (13B) of a wale interior to said stitch (13A) at one end of the second knitted fabric with the stitch (15);

(9) a process of forming a stitch (19) over the double stitches overlapped by the process (8); and

(10) a process of transferring the stitch (19) formed by the process (9) over the trick gap in such a way that the stitch (19) will cross with the stitch (18).

The temporal sequence of the processes (1) through (10) is indicated by referring a process that must precede in defining a subsequent process. Accordingly, if any preceding process is not referred to, the sequence of some processes may be changed; for example, the process (3) may be done before the process (2).

Preferably, in said process (5) the stitch (12B) is transferred and overlapped with the stitch (14), and in said process (8) the stitch (13B) is transferred and overlapped with the stitch (15). Moreover, preferably, in said processes (1) and (3) two stitches are formed respectively.

A tubular knitted fabric according to the present invention consists of a front knitted fabric and a back knitted fabric, and each stitch of the last course of the front knitted fabric is overlapped with a stitch, one stitch interior, of an immediately preceding course of the front knitted fabric, each stitch of the last course of the back knitted fabric is overlapped with a stitch, one stitch interior, of an immediately preceding course of the back knitted fabric, and each stitch of the last course of the front knitted fabric crosses with a stitch of the last course of the back knitted fabric.

Binding according to the present invention joins a front knitted fabric and a back knitted fabric by crossing stitches. Each stitch has a loop at the top end and two prolongations on both sides thereof, and when stitches are crossed with each other or when their prolongations are crossed with each other, two yarns will be crossed with other two yarns. Accordingly, in comparison with the conventional method of crossing one yarn with another yarn, the tensile strength of the bound portion is increased. Further, when crossed stitches of a bound portion are overlapped with a stitch to be bound, the stitch to be bound will come above the crossed stitches, thus the crossed stitches will be concealed under the stitch to be bound, resulting in a binding of neat appearance. In the present specification, arrangement of stitches in knitted fabrics is indicated by courses and wales. A course is a row of stitches arranged in parallel with the needle beds during knitting, and a wale is a row of stitches perpendicular to the needle beds.

A CAD apparatus of the present invention is designed to generate a binding-off method that uses a flat knitting machine with a built-in computer, having at least a pair of a front needle bed and a rear needle bed, each of said needle beds having a large number of needles, using a space between said at least pair of needle beds as a trick gap, at least one of said needle beds being slidable to the right and to the left, and having at least a yarn feeder for feeding yarn to needles of needle beds to bind two knitted fabrics, a front knitted fabric and a back knitted fabric, and generates commands for following processes:

a: to form new stitches subsequent to stitches of said two knitted fabrics, front knitted fabric and back knitted fabric;

b: to transfer said new stitches to the opposing needle beds so as to cross the prolongations of said new stitches with each other; and c: after that, to overlap said new stitches with interior stitches of said two knitted fabrics, front one and back one.

The flat knitting machine is driven by the built-in computer of the flat knitting machine that reads knitting commands stored in a disc, etc. The computer of the flat knitting machine interprets the knitting commands to drive various mechanisms of the flat knitting machine. The major knitting methods including the binding-off method are stored, as subroutines, in a CAD apparatus for designing knitted fabrics. A CAD apparatus of this kind is provided with a computer and an output device and is capable of writing knitting commands in a disc, etc. The CAD apparatus stores knitting commands concerning major factors of knitting, such as tubular knitting, increasing the number of stitches, decreasing the number of stitches and binding, as subroutines, and outputs knitting commands by combining subroutines corresponding to various parts of a knitted fabric designed by a user. The knitting commands include commands for a flat knitting machine with a built-in computer to knit the knitted fabric. It is widely known that a flat knitting machine is driven by a built-in computer thereof, the built-in computer reads out knitting instructions stored in a disc, etc., and said knitting commands are generated by a CAD apparatus that interprets a design drawing of the knitted fabric designed by a user on the CAD apparatus.

BRIEF DESCRIPTIONS OF THE DRAWINGS

FIG. 3-1 through FIG. 3-6, FIG. 4-1 through FIG. 4-6, and FIG. 5-1 through FIG. 5-6 are knitting course diagrams of a first embodiment.

Figures 1, 3:
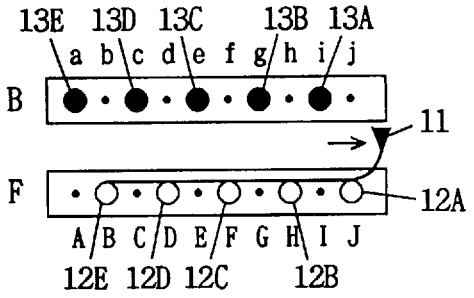
Figures 2, 3:
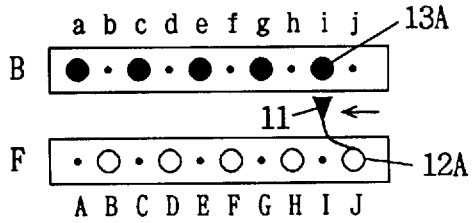
Figure 3:
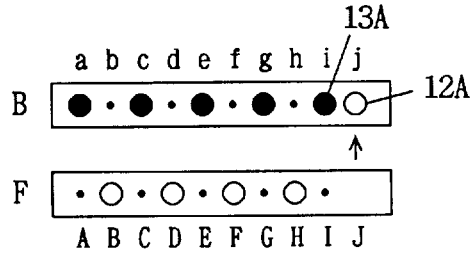
Figures 3, 4:
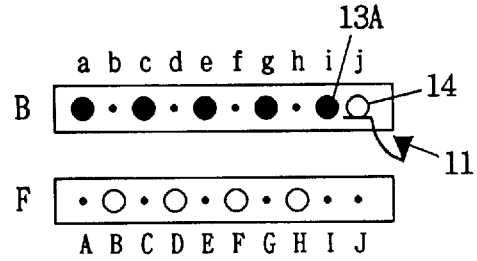
Figures 3, 4, 5:
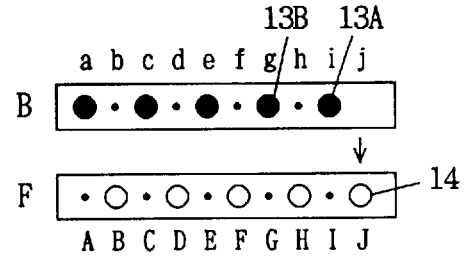
Figures 3, 4, 5, 6:
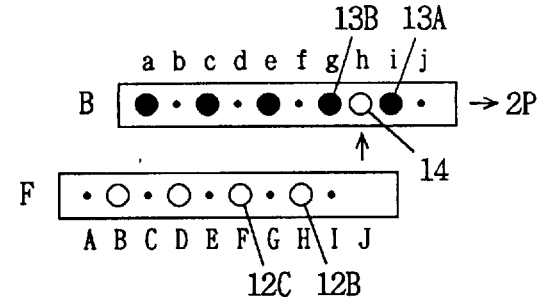
Figures 1, 4:
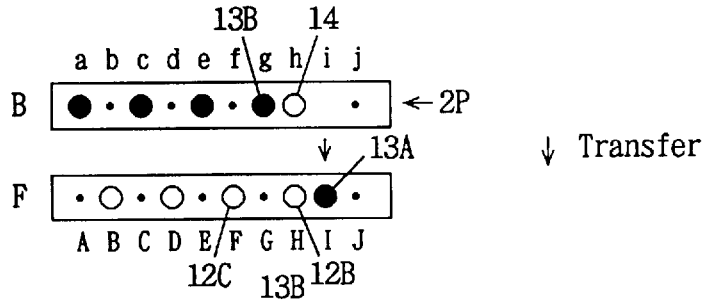
Figures 2, 4:
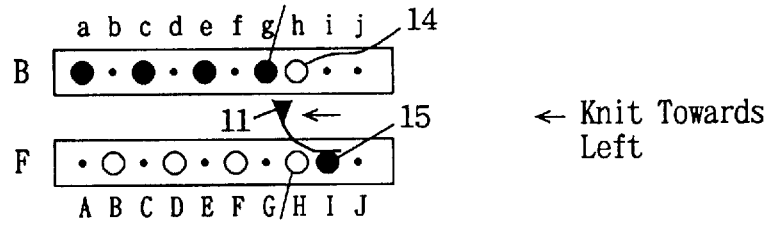
Figures 3, 4:
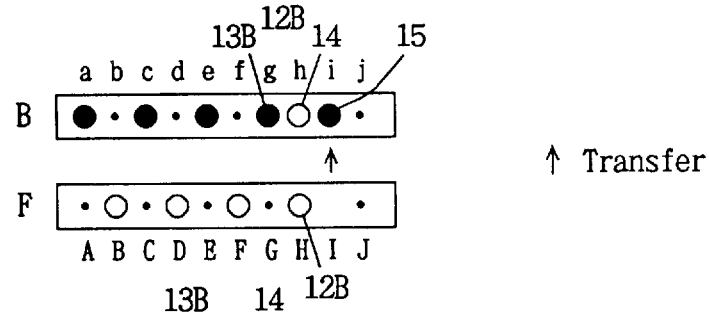
Figure 4:
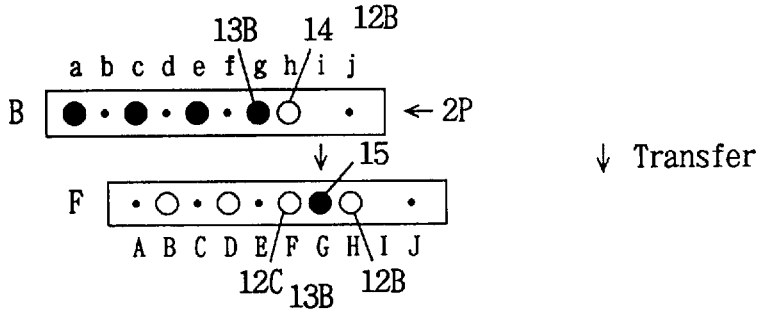
Figures 4, 5:
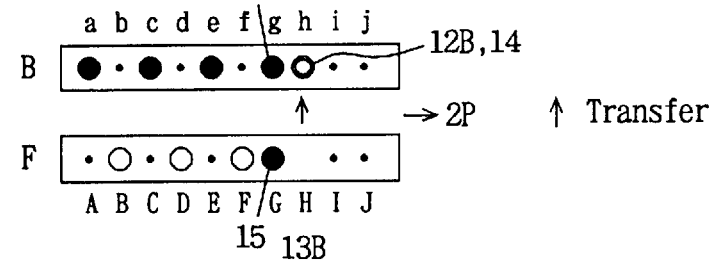
Figures 4, 5, 6:
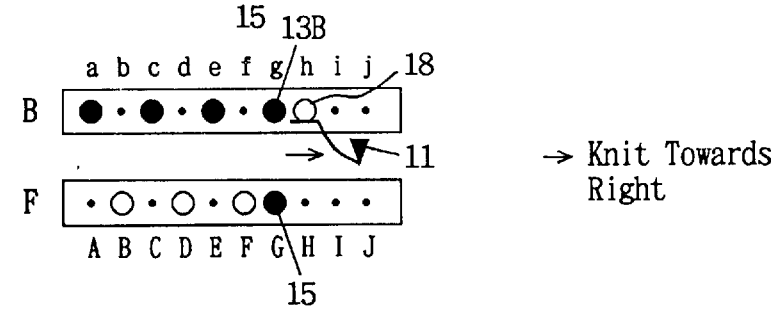
Figures 1, 2, 3, 4, 5, 6:
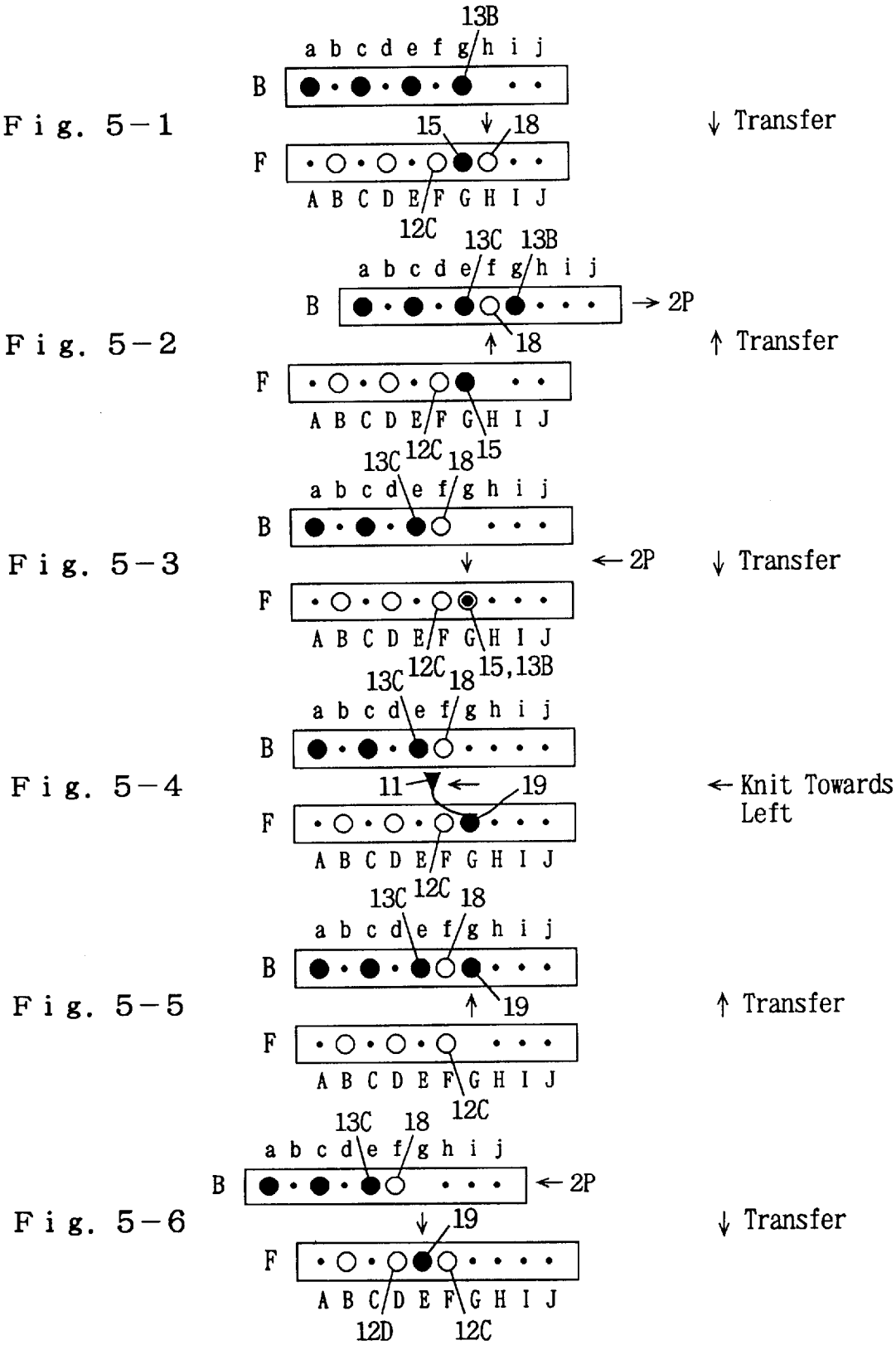
Figure 6:
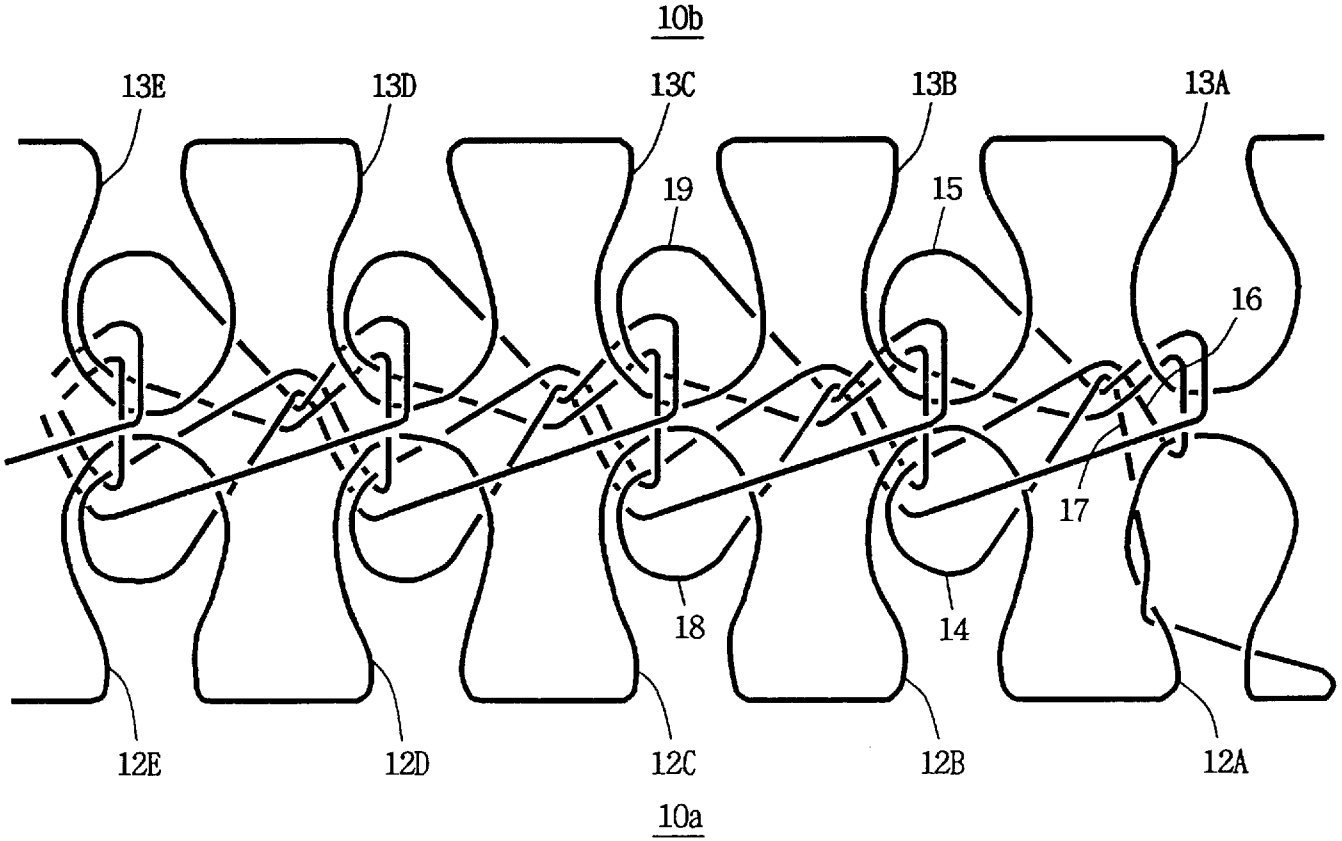
Figures 1, 7:
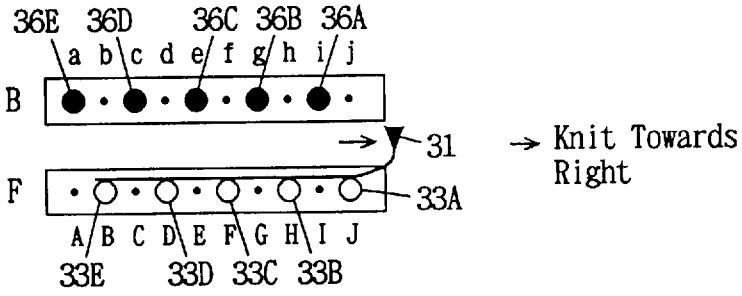
Figures 2, 7:
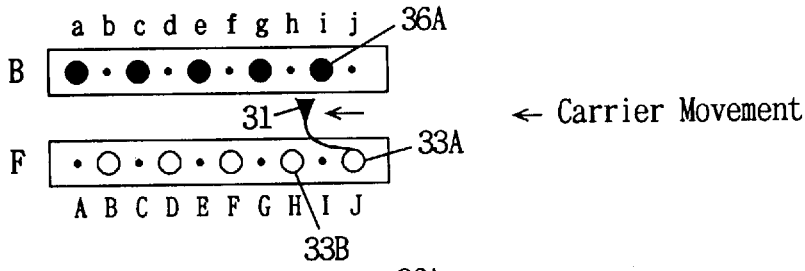
Figures 3, 7:
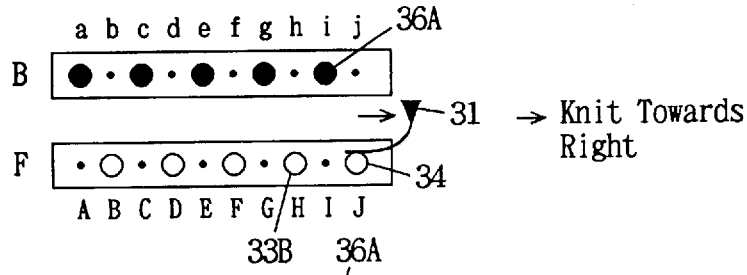
Figures 4, 7:
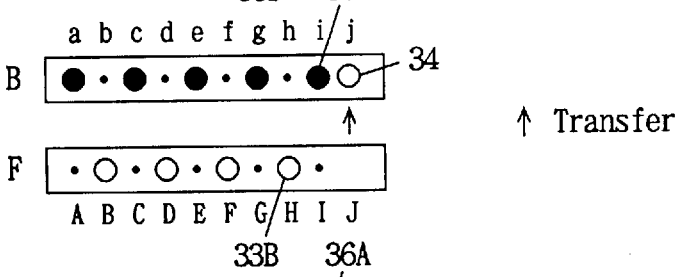
Figures 5, 7:
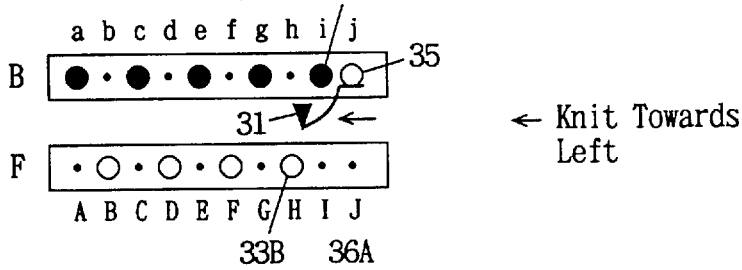
Figures 6, 7:
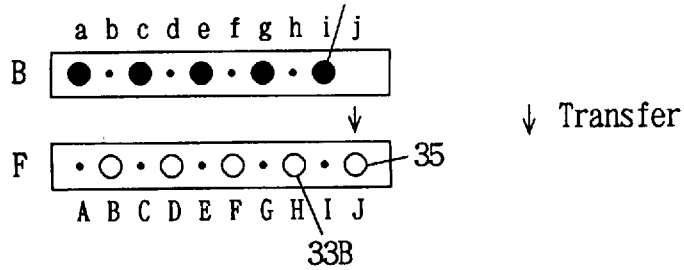
Figures 1, 8:
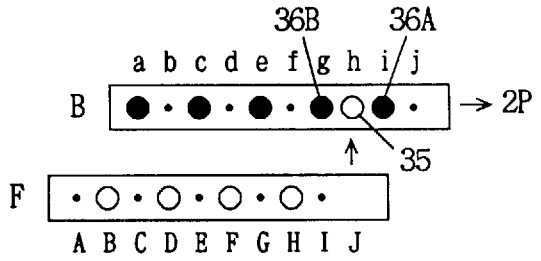
Figures 2, 8:
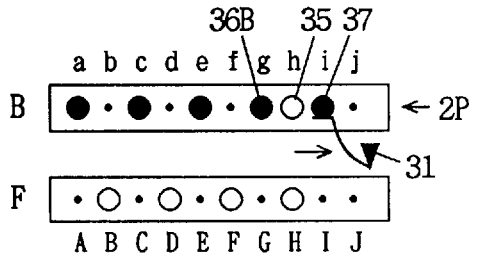
Figures 3, 8:
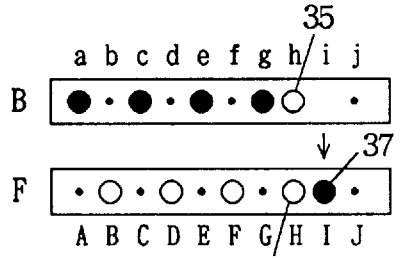
Figures 4, 8:
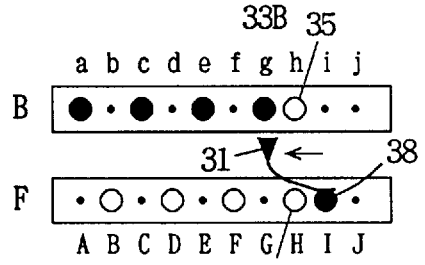
Figures 5, 8:
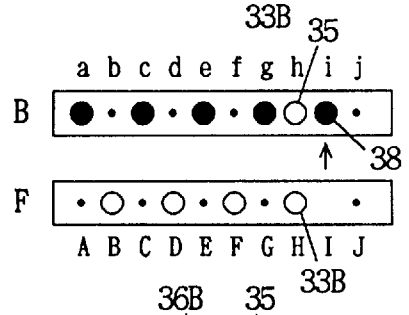
Figures 6, 8:
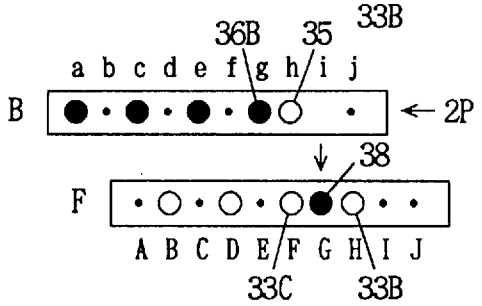
Figures 1, 9:
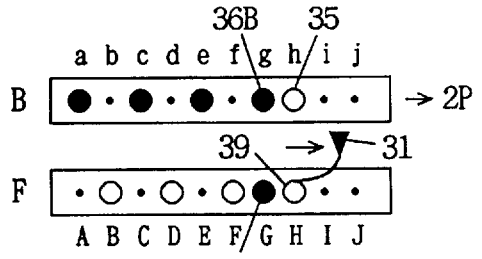
Figures 2, 9:
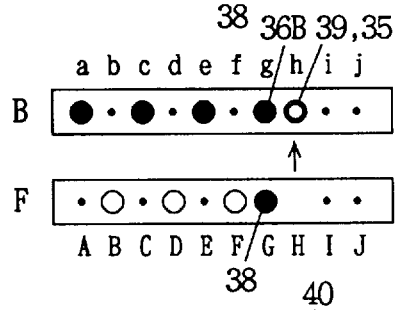
Figures 3, 9:
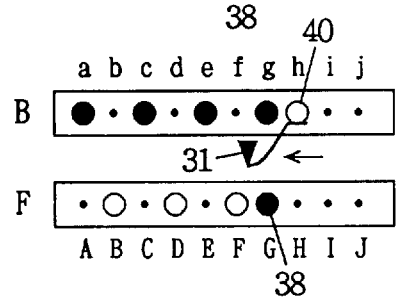
Figures 4, 9:
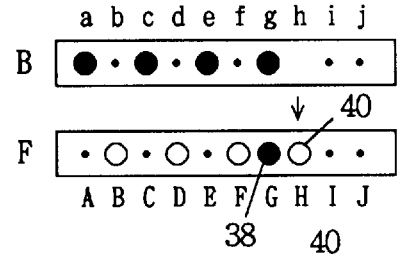
Figures 5, 9:
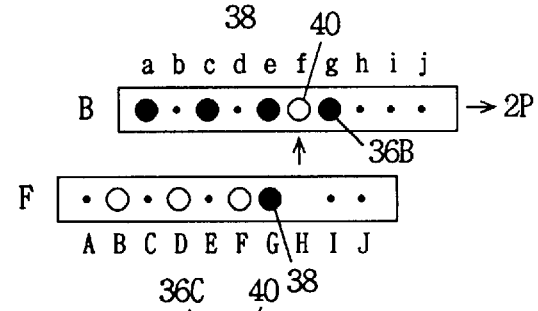
Figures 6, 9:
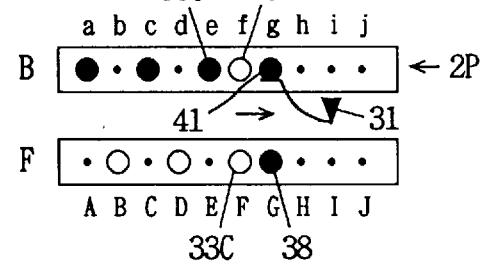
Figures 1, 10:
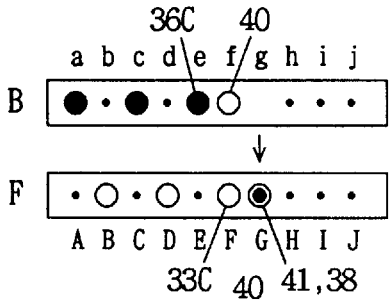
Figures 2, 10:
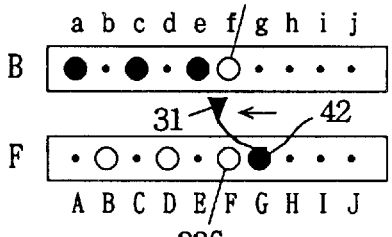
Figures 3, 10:
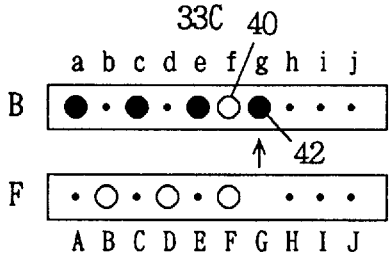
Figures 4, 10:
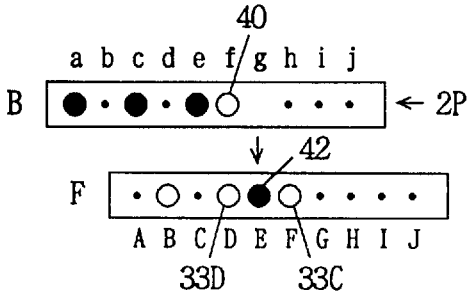

FIG. 6 is a loop diagram of knitted fabrics knitted in the first embodiment.

FIG. 7-1 through FIG. 7-6, FIG. 8-1 through FIG. 8-6, FIG. 9-1 through FIG. 9-6, and FIG. 10-1 through FIG. 10-4 are knitting course diagrams showing a second embodiment.

Figure 11:
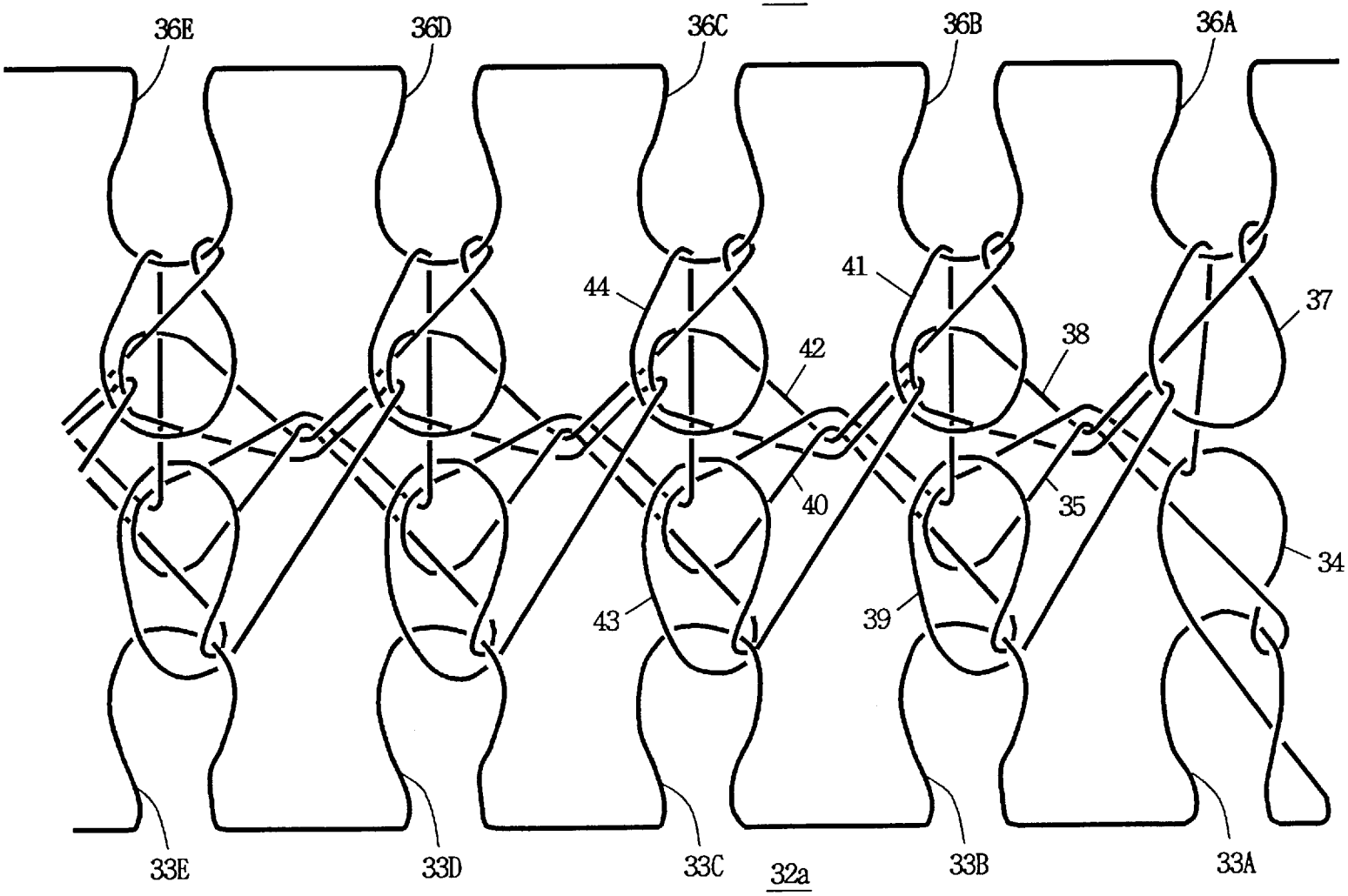

FIG. 11 is a loop diagram of knitted fabrics knitted in the second embodiment.

FIG. 12 is a diagram showing variations of the first embodiment.

FIG. 13 is a diagram showing variations of the second embodiment.

EMBODIMENTS

Figure 1:
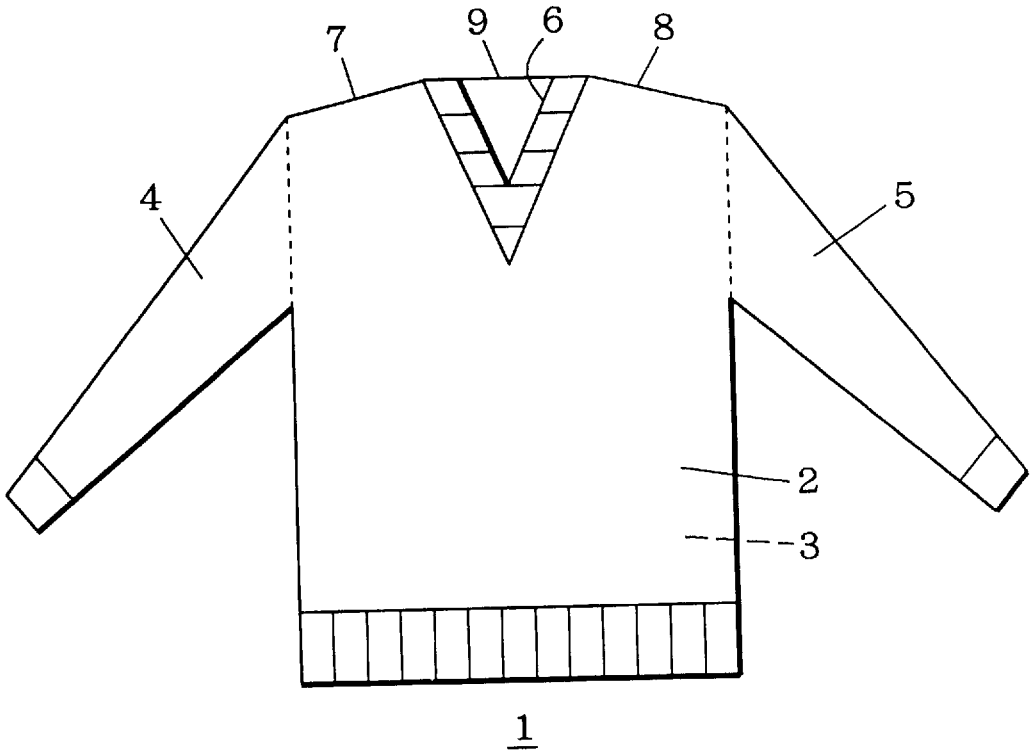
FIG. 1 is a diagram showing a sweater that is knitted by using the binding-off method of the present invention.
Figure 2:
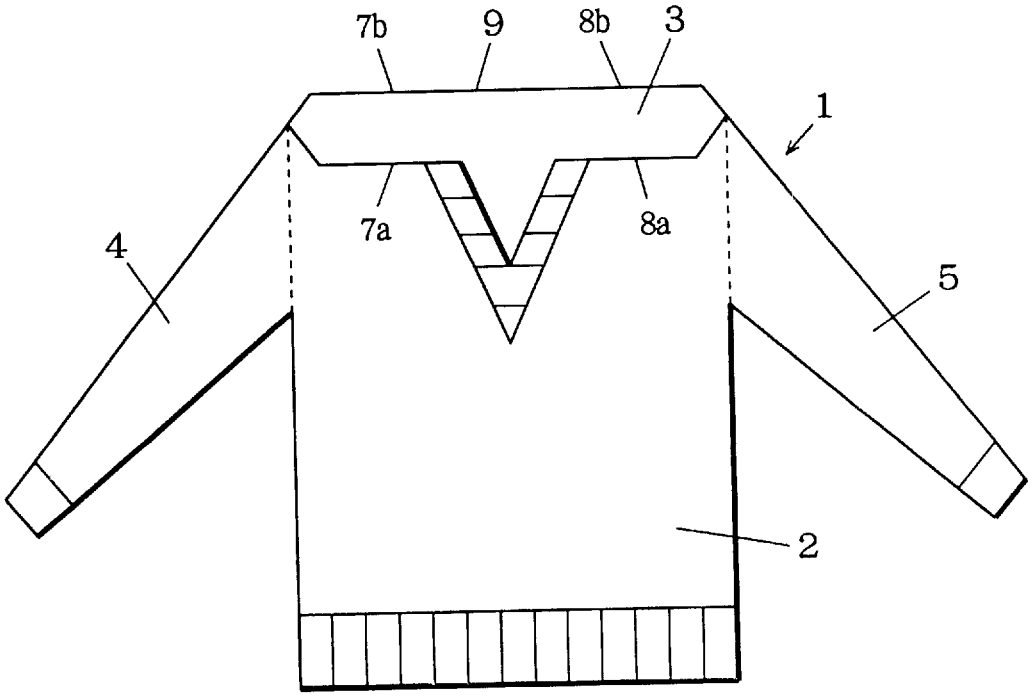
FIG. 2 is a diagram showing the sweater before the beginning of binding at the shoulders.

Embodiments of the binding-off method according to the present invention will be described with reference to the drawings. FIG. 1 shows the state of a sweater 1 to be knitted, at the time of completion thereof. The sweater 1 is knitted by using needles of plural regions of needle beds; bodies 2 and 3 and a right sleeve and a left sleeve are knitted in the form of tubular knitted fabrics. After that, both the right and left sleeves 4 and 5 are transferred to the sides of bodies 2 and 3 and joined to the bodies 2 and 3. When joining of the right and left sleeves 4 and 5 and the bodies 2 and 3 is completed, the front body 2 and the back body 3 are joined together, as shown in FIG. 2, at both ends thereof. The two bodies, however, are not joined at the shoulders yet. On needles of a front bed F, stitches of a right front shoulder 7*a* and stitches of a left front shoulder 8*a* are held with an opening for collar 6 being located between the two sets of stitches. On needles of a rear bed B, stitches of a right back shoulder 7*b* and stitches of a left back shoulder 8*b* are held with a back collar 7 corresponding to the opening for collar 6 being located between the two sets of stitches. Knitting up to this stage is well known because of Japanese Patent HEI-4-15301.

The right front shoulder 7*a* and the right back shoulder 7*b* are joined together and bound off and the left front shoulder

8*a* and the left back shoulder 8*b* are joined together and bound off. The knitting of the right shoulder 7 and the knitting of the left shoulder 8 are bilaterally symmetrical. Hence the binding of the left shoulder 8 will be described in the following. The left front shoulder 8*a* will be referred to as a front knitted fabric 10*a* and the left back shoulder 8*b* as a back knitted fabric 10*b*, respectively, and the numbers of needles will be reduced in the description than they actually are. The present invention will be effected with a flat knitting machine in which at least two needles beds, for example, two needle beds or four needle beds, are arranged to oppose to each other, one in the front and one in the rear and at least one needle bed, the front needle bed or the rear needle bed, is slidable to the right and to the left. In embodiments, a flat knitting machine with two needle beds is used, and its rear needle bed alone is slidable to the right and to the left. In the embodiments, to shaped-knit a tubular knitted fabric on a flat knitting machine with two needle beds, needles of odd numbers of both the front needle bed and the rear needle bed are used, for example, for a front knitted fabric, and needles of even numbers are used, for example, for a back knitted fabric, as disclosed in Japanese Patent HEI-3-75656. However, when a flat knitting machine with four needle beds is used, such a restraint on needles of odd numbers and needles of even numbers will not be imposed.

First, the first embodiment will be described with reference to the knitting course diagrams of FIG. 3 through FIG. 5. Knitted fabrics knitted in the embodiment are shown in FIG. 6. In the course 3-1 of FIG. 3, a yarn feeder 11 being movable in the longitudinal direction of the front and rear needle beds is moved above a trick gap of the front and rear needle beds to feed yarn from the yarn feeder 11 to needles B, D, F, H and J of the front needle bed F and form stitches that will constitute the final course of the front knitted fabric 10*a* or stitches to be bound off. This is the state of the sweater 1 shown in FIG. 2. At this point, stitches of the front knitted fabric 10*a* to be bound off 12E, 12D, 12C, 12B and 12A are held on every other needle B, D, F, H and J of the front needle bed F, and stitches of the back knitted fabric 10*b* to be bound off 13E, 13D, 13B and 13A are held on every other needle a, c, e, g and i of the rear needle bed B. The stitches of the front knitted fabric 10*a* are indicated by a white dot and stitches of the back knitted fabric 10*b* are indicated by a black dot. In the course 3-2 and after, the front knitted fabric 10*a* and the back knitted fabric 10*b* are joined together and bound off. In the course 3-2, the yarn feeder 11 is shifted to the left of the needle J of the front needle bed F. Next, in the course 3-3, the stitch 12A at one end of the front knitted fabric 10*a* is transferred onto the needle j of the opposing needle bed B. The needle j is immediately exterior to the stitch 13A at one end of the back knitted fabric 10*b*. Next, in the course 3-4, the yarn feeder 11 is shifted to the right to feed yarn to the needle j of the rear needle bed B to form a stitch 14 over the stitch 12A. The stitch 14 will become a crossed stitch later and belongs to the front knitted fabric 10*a*. Next, in the course 3-5, the stitch 14 is transferred onto the needle J of the front needle bed F. In the course 3-6, the rear needle bed B is racked to the right by two pitches (by two needles), then the stitch 14 is transferred onto the needle h of the rear needle bed B.

Next, in the course 4-1, the rear needle bed B is racked to the left by two pitches, then the stitch 13A at one end of the back knitted fabric 10*b* being held on the needle i of the rear needle bed B is transferred onto the needle I of the opposing front needle bed F. Next, in the course 4-2, the yarn feeder 11 is shifted to the left to feed yarn to the needle I of the front needle bed F to form a stitch 15 over the stitch 13A. The stitch 15 will become a crossed stitch later and belongs to the back knitted fabric 10*b*. Next, in the course 4-3, the stitch 15 is transferred from the needle I of the front needle bed F onto the needle i of the rear needle bed B. In the course 4-4, the rear needle bed B is racked to the left by two pitches, and the stitch 15 is transferred onto the needle G of the front needle bed F. At the time, the stitch 15 is transferred, over the yarns 16 and 17 between the stitch 14 and the stitch 12B (illustrated in FIG. 6), to the front needle bed F. As a result, the stitch 14 and the stitch 15 will cross with each other.

Next, in the course 4-5, the stitch 12B is overlapped with the stitch 14. In the course 4-6, the yarn feeder 11 is shifted to the right to form a new stitch 18. As a result, the stitch 18 is newly formed over the double stitches of the stitch 14 and the stitch 12B. Hence the stitch 14 and the stitch 15 are held in a crossed condition. The formation of the stitch 18 in the course 4-6 results in binding, by one stitch, of the front knitted fabric 10*a*. Next, in the course 5-1, the stitch 18 is transferred onto the needle H of the front needle bed F. Further, in the course 5-2, the rear needle bed B is racked to the right by two pitches, then the stitch 18 is transferred again onto the needle f of the rear needle bed B. This is a preparation for crossing the stitch 19 of the back knitted fabric 10*b* with the stitch 18 of the front knitted fabric.

Next, in the course 5-3, the stitch 13B is transferred onto the needle G of the opposing front needle bed F to overlap the stitch 13B with the stitch 15. In the course 5-4, the yarn feeder 11 is shifted to the left to feed yarn to the needle G of the front needle bed F to form a stitch 19. As a result, the stitch 18 is formed over the stitches 14 and 12B, the stitch 19 is formed over the stitches 15 and 13B, and the stitch 14 and the stitch 15 is kept in a crossed condition. In this way, the back knitted fabric 10*b* is bound by one stitch. Next, in the course 5-5, the stitch 19 is transferred onto the needle g of the rear needle bed B. Then, in the course 5-6, the rear needle bed B is racked to the left by two pitches, then the stitch 19 is transferred onto the needle E of the front needle bed F. As a result, the stitch 18 and the stitch 19 are crossed with each other. In the subsequent courses, the knitting of the course 4-5 through the course 5-6 is repeated to join and bind the front knitted fabric 10*a* and the back knitted fabric 10*b* by one stitch at a time.

Knitted fabrics bound by the above-mentioned processes are shown in FIG. 6. Stitches 12A–E of the front knitted fabric 10*a* and stitches 13A–E of the back knitted fabric 10*b* are bound. The stitch 14 crosses with the stitch 15, and the stitch 18 crosses with the stitch 19. The stitch 14 is overlapped with the stitch 12B, and the stitch 18 is overlapped with the stitch 12C. In a similar manner, the stitch 15 is overlapped with the stitch 13B, and the stitch 19 is overlapped with the stitch 13C. The stitches 14 and 18 are formed on the rear needle bed B, and the stitches 15 and 19 are formed on the front needle bed F. Hence the stitches 14, 18, 15 and 19 are buried beneath the front knitted fabric or the back knitted fabric. The stitch 14 and the stitch 15 cross with each other, and the stitch 18 and the stitch 19 cross with each other, and these stitches are pulled in such a direction that these stitches will be buried beneath the front knitted fabric or the back knitted fabric. In addition to them, the stitches 12A–E and the stitches 13A–E are pulled towards the back of the knitted fabrics (the back of the tubular fabric), thus the bound portions will not swell. When the knitted fabrics are offered as a product and the bound portions are strained at the time of wearing, the stitches 14, 15, 18 and 19 will be pulled in such a direction that these stitches will submerge into the back of the garment (back of the tubular knitted fabric) and the strained stitches 14, 15, 18 and 19 will not be pulled out to the surface of the garment. The stitches 14 and 18 are placed beneath the stitches 12B and 12C, respectively, and the stitches 15 and 19 are placed beneath the stitches 13B and 13C, respectively. As a result, the stitches 12A–E and the stitches 13A–E appear on the surface of the garment, and the stitches 14, 18, 15 and 19 and the crossed portions of these stitches are located in the back of the garment. Accordingly, no ups and downs are generated in the bound portions, and the garment is flat at the bound portions. Furthermore, the stitches 14 and 15, and the stitches 18 and 19 are crossed with each other, thus the front knitted fabric and the back knitted fabric are joined together by crossing two yarns of each stitch. In comparison with the conventional method wherein one yarn of each stitch is crossed with, the joint of the garment has a greater strength. Further, the stitches are crossed with each other only after the formation of these stitches is completed. Hence, in contrast with the case of crossing yarns, the yarn is not pulled out of the yarn feeder 11 during crossing. As a result, the knitted fabrics are pulled to each other, leaving no gap between the knitted fabrics.

A second embodiment will be described with reference to FIG. 7 through FIG. 10. The fabrics knitted is shown in FIG. 11. It is common to the first embodiment and the second embodiment that binding is effected by using crossed stitches 14, 15, 18, 19, 35, 38, 40 and 42. It is also common to the first and second embodiments that the crossed stitches 14, 18, 35 and 40 of the front knitted fabric are formed on the rear needle bed B and the crossed stitches 15, 19, 38 and 42 of the back knitted fabric are formed on the front needle bed F. In the first embodiment, the crossed stitches 14, 15, 18 and 19 were overlapped with the stitches to be bound 12A–E and 13A–E. In contrast to it, in the second embodiment, intermediate stitches 34, 39 and 43 are formed above the stitches to be bound 33A–E, and intermediate stitches 37, 41 and 44 are formed above the stitches to be bound 36A–E. These intermediate stitches 34, 39, 43, 37, 41 and 44 are not crossed. Then the crossed stitches 35 and 40 are overlapped with the intermediate stitches 39 and 43, and the crossed stitches 38 and 42 are overlapped with the intermediate stitches 41 and 44. The second embodiment will be described in the following. First, in the course 7-1 and the course 7-2, in a similar manner to the first embodiment, a yarn feeder 31 is shifted to the right to form stitches to be bound 33A, 33B, 33C, 33D and 33E of a front knitted fabric 32*a*, then the yarn feeder 31 is shifted to the left. Next, in the course 7-3, the yarn feeder 31 is reversed and shifted to the right to feed yarn to a needle J of a front needle bed F on which a stitch 33A being at one end of the front knitted fabric is being held to form an intermediate stitch 34 above the stitch 33A. Next, in the course 7-4, the stitch 34 is transferred onto a needle j of the opposing rear needle bed B. Next, the yarn feeder 31 is reversed and shifted to the left of the needle J to feed yarn to the needle j of the rear needle bed B and form a stitch 35 which will be crossed later. In the course 7-6 and the course 8-1, knitting similar to that of the course 3-5 and the course 3-6 of the first embodiment is made, and the stitch 35 is transferred to the needle h of the rear needle bed B.

Next, in the course 8-2, the yarn feeder 31 is shifted to the right to feed yarn to a needle i of the rear needle bed B on which a stitch 36A being at one end of the back knitted fabric 32 is being held to form an intermediate stitch 37 above a stitch 36A. Next, in the course 8-3, the stitch 37 is transferred onto a needle I of the opposing front needle bed F. Further, in the course 8-4, the yarn feeder 31 is reversed and shifted to the left to feed yarn to the needle I of the front needle bed F to form a stitch 38 that will be crossed later. Then, in the course 8-5 and in the course 8-6, knitting similar to that of the course 4-3 and the course 4-4 of the first embodiment will be made, and the stitch 38 will be transferred onto a needle G of the front needle bed F. As a result, the stitch 35 formed in succession to the stitch 34 being in the final course of the front knitted fabric and the stitch 38 formed above the stitch 37 of the back knitted fabric are crossed with each other.

Next, in the course 9-1, the yarn feeder 31 is shifted to the right to feed a needle H of the front needle bed F to form an intermediate stitch 41 above the stitch 36B. Next, in the course 9-2, the stitch 41 is transferred onto a needle h of the opposing rear needle bed B and overlap the stitch 41 with the stitch 38 to form a double stitch. As shown in the course 7-3 through the course 7-5 and the course 9-1 through the course 9-3, in the second embodiment, the crossed stitches 35, 40, 38 and 42 are not overlapped with the stitches 33B, 33C, 36B and 36C but with the intermediate stitches 39, 41, 43 and 44. On this point the second embodiment differs from the first embodiment. Next, in the course 9-3, the yarn feeder 31 is shifted to the left to feed yarn to a needle h of the rear needle bed B to form a stitch 40 above the double stitch; the stitch 40 will be crossed later. As a result, the stitches of the front knitted fabric are reduced by one stitch from the state of the course 7-1, and one stitch is bound. Then, in the course 9-4 and the course 9-5, knitting similar to that of the course 7-6 and the course 8-1 is done to prepare for crossing of stitches.

Next, in the course 9-6, the yarn feeder 31 is shifted to the right to form an intermediate stitch 41, by means of a needle g of the rear needle bed B, above the stitch 36B. Next, in the course 10-1, the stitch 31 is transferred onto the needle G of the front needle bed F to overlap the stitch 31 with the stitch 38 and form a double stitch. Next, in the course 10-2, the yarn feeder 31 is shifted to the left to feed yarn to the needle G of the front needle bed F and form a stitch 42 above the double stitch; the stitch 42 will be crossed later. As a result, the stitch 35 following the stitches 33A and 34 and the stitch 38 following the stitches 36A and 37 are held in a crossed condition. The stitches of the back knitted fabric 32*b* are also decreased by one stitch from the state of the course 7-1. Then, in the course 10-3 and the course 10-4, knitting similar to that in the course 9-4 and the course 9-5 is made. As a result, binding of one stitch is completed in both the front knitted fabric 32*a* and the back knitted fabric 32*b*. Then, knitting of the course 9-1 through the course 10-4 is repeated to join the front knitted fabric 32*a* and the back knitted fabric 32*b* and bind one stitch at a time; the bound stitch is disconnected from the needle bed.

Knitted fabrics bound by the above-mentioned processes are shown in FIG. 11. Stitches 35 and 40 formed in succession to the front knitted fabric 32*a* are crossed with stitches 38 and 42 formed in succession to the back knitted fabric 32*b*. When the crossed stitches 35, 38, 40 and 42 are overlapped with the intermediate stitches 39, 41, 43 and 44, they are overlapped in such a way that the stitches 39, 41, 43 and 44 will take upper positions. Further, as the intermediate stitches 34, 37, 39, 41, 43 and 44 are formed, stitches will concentrate at the binding portions. This prevents the knitted fabrics from growing transparent at the bound portions.

The first embodiment and the second embodiment are typical examples. There are a large number of variations according to, for example, the needle bed used to form crossed stitches, the direction of yarn feeding when crossed stitches are formed, and the number of yarn feeders used (one or two). The major variations are shown in FIG. 12 and FIG. 13. FIG. 12 shows variations of the first embodiment wherein crossed stitches are overlapped with stitches to be bound. FIG. 13 shows variations of the second embodiment wherein one or plural rows of intermediate stitches are formed in succession to the stitches to be bound and the crossed stitches are overlapped with the row of intermediate stitches. Regarding the quality of knitted fabrics shown in the diagrams, 5 indicates the highest quality. Regarding the knitting rank, 5 indicates the easiest knitting.

In FIG. 12, there are versions according to two knitting methods: stitches 14 and 18 are formed on the rear needle bed B and stitches 15 and 19 are formed on the front needle bed F (Y-1); and stitches 14 and 18 are formed on the front needle bed F and stitches 15 and 19 are formed on the rear needle bed B (X-1). There are three versions L, M and N according to the shift direction of the yarn feeder 11 at the time of formation of stitches 14, 15, 18 and 19. Hence a total of six patterns are shown in FIG. 12. In the following, description will be centered around the knitting of the stitch 18. The first embodiment is a combination of the knitting method Y-1 and the yarn feeder shift direction L. According to this knitting method, as shown in the course 4-5, stitches are overlapped with each other by, first starting from a state wherein a stitch is held on the needle H of the front needle bed and a stitch is held on the needle h of the rear needle bed, and transferring the stitch on the needle H of the front needle bed onto the rear needle bed, and in the course 4-6, a stitch 18 is formed above a double stitch by a needle of the rear needle bed, Next, in the course 5-1, the stitch 18 is transferred from the rear needle bed to the front needle bed, and in the course 5-2, the rear needle bed is racked by two pitches, then the stitch 18 is transferred from the front needle bed F to the rear needle bed B. On the other hand, according to the knitting method X-1, in place of the course 4-6, a stitch is formed above a double stitch by a needle of the front needle bed F, and the formed stitch is not subjected to the transfer of the course 5-1, and as shown in the course 5-2, the formed stitch is directed transferred to the rear needle bed B. As explained above, there are two patterns of knitting method, the knitting method X-1 and the knitting method Y-1, according to which stitch of two stitches, one on the front needle bed and the other on the rear needle bed, is transferred. The shift direction L of the yarn feeder 11 is a pattern wherein the yarn feeder 11 is shifted to the right when a stitch of the front knitted fabric 10*a* is formed, and the yarn feeder 11 is shifted to the left when a stitch of the rear knitted fabric 10*b* is formed. The shift direction M of the yarn feeder is opposite to it, and is a pattern wherein the yarn feeder is shifted to the left when to knit the front knitted fabric 10*a*, and the yarn feeder is shifted to the right to knit the rear knitted fabric 10*b*. The shift direction N of the yarn feeder is a pattern wherein the yarn feeder 11 is shifted to the left to form a stitch on one knitted fabric, then, before a stitch is formed on the other knitted fabric, the yarn feeder 11 is shifted to the right of a needle on which next stitch is formed; thus stitches of both the front knitted fabric 10*a* and the rear knitted fabric 10*b* are knitted by shifting the yarn feeder 11 in the advancing direction of bound stitches.

FIG. 13 shows variations of the second embodiment; two kinds of knitting method and three kinds of shifting direction of the yarn feeder or feeders are combined to have a total of six variations. The second embodiment is a combination of the knitting method Y-2 and the yarn feeder shifting direction O. There are two knitting methods X-2 and Y-2, and both methods form intermediate stitches before knitting of the knitting methods X-1 and Y-1; they perform knitting of X-1 and Y-1 only after forming intermediate stitches. Thus other portions of X-2 and Y-2 except formation of intermediate stitches are common to the knitting methods X-1 and Y-1. On the other hand, there are three kinds of yarn feeder shifting direction O, P and Q. The yarn feeder shifting direction O is a pattern wherein as shown in the course 7-3, a stitch 34 is formed above a stitch 33A by shifting a yarn feeder 31 to the right or the direction opposite to the advancing direction of binding, and in the course 7-4, the stitch 34 is transferred onto a needle of the rear needle bed, and in the course 7-5, a crossed stitch 35 which is to be overlapped with an intermediate stitch 39 is formed by shifting the yarn feeder 31 in the advancing direction of binding. The yarn feeder shifting direction P is the reverse of O and is a pattern wherein in a course corresponding to the course 7-3 in which the stitch 34 is formed above the stitch 33A, a stitch 34 is formed by shifting the yarn feeder in the advancing direction of binding, and in a course corresponding to the course 7-5, the yarn feeder 31 is shifted to the right or the direction opposite to the advancing direction of binding to form a stitch 35. The yarn feeder shifting direction Q is a pattern wherein different yarn feeders are used to knit a front knitted fabric 32*a* and a back knitted fabric 32*b*, respectively.

Many variations of the method of implementing this invention are conceivable. One important thing is that crossed stitches 14, 18, 15, 19, 35, 40, 38 and 42 are used and the crossed stitches of the front knitted fabrics 10*a* and 32*a* are crossed with the crossed stitches of the back knitted fabrics 10*b* and 32*b*. It is also important that the crossed stitches 14, 18, 15, 19, 35, 40, 38 and 42 are overlapped in such a way that they are beneath the stitches 12B, 12C, 39, 43, 13B, 13C, 41 and 44, and that stitches 18, 19, 40 and 42 are formed above these double stitches. In the embodiments, examples of knitting with a flat knitting machine with two beds were described, but knitting is also possible with a flat knitting machine with four beds. In this case, the needles of even numbers B, D, F, H and J of the front needle bed F are substituted by needles of a front lower needle bed, the needles of odd numbers A, C, E, G and I of the front needle bed F are substituted by needles of a front upper needle bed, the needles of even numbers b, d, f, h and j of the rear needle bed B are substituted by needles of the rear lower needle bed, and the needles of odd numbers a, c, e, g and i of the rear needle bed are substituted by needles of a rear upper bed. With regard to transfer in the course 3-6, the course 4-4, the course 8-1, the course 8-6, etc., the stitches 14, 15, 35 and 38 may be transferred onto any needles of the opposing upper bed where they will not disturb advance or retreat of any needles of the lower bed which will be advanced later. In the embodiments, stitches 14, 18, 15, 19, 35, 40, 41 and 42 were transferred in the advancing direction of binding to cross the stitches, but these stitches may be crossed by shifting them in the direction opposite to the advancing direction of binding.

We claim:

1. A binding-off method, said method comprising the steps of:

providing a flat knitting machine for binding two knitted fabrics, having at least a pair of needle beds comprising a front needle bed and a rear needle bed, each of said front and rear needle beds having a plurality of needles, wherein a space between said pair of needle beds forms a trick gap, at least one of said front and rear needle beds being slidable to the right and to the left, said flat knitting machine having a yarn feeder for feeding yarn to at least one needle of the plurality of needles of the needle beds, wherein each knitted fabric is provided with a large number of stitches, each of said stitches consisting of a loop and prolongations on both sides thereof; said method further comprising the steps of a. forming new stitches in succession to stitches of the respective two knitted fabrics, said two knitted fabrics comprising a front fabric and a rear fabric;

b. transferring said new stitches to opposing needle beds to make the prolongations of said new stitches cross each other;

c. overlapping said new stitches with interior stitches of said two knitted fabrics; and repeating steps a, b, and c from one side end of each of the two knitted fabrics toward interior portions thereof.

2. A binding-off method, said method comprising the steps of:

providing a flat knitting machine for binding at least two knitted fabrics, having at least a pair of needle beds comprising a first needle bed and a second needle bed opposed to each other, with one of the first and second needle beds being in a front of the knitting machine and the other of the first and second needle beds being in a rear of the knitting machine, each of said needle beds having a plurality of needles, wherein a space between said first needle bed and said second needle bed forms a trick gap, at least one of said first needle bed and said second needle bed being slidable to the right and to the left, said knitting machine having at least a yarn feeder for feeding yarn to at least one needle of the plurality of needles of the first needle bed and the second needle bed, each of said knitted fabrics consisting of a large number of stitches, each stitch consisting of a loop and prolongations on both sides thereof, and wherein a large number of stitches of each knitted fabric are arranged in a direction parallel to and in a direction perpendicular to the pair of needle beds, a row of stitches being parallel to the needle beds being defined as a course and a row of stitches being perpendicular to the needle beds being defined as a wale, said method further comprising the steps of:

(1) forming at least a second stitch (14) in succession to a first stitch (12A) at one end of a binding area of a first knitted fabric of said pair of knitted fabrics;

(2) transferring the second stitch (14), over the trick gap;

(3) forming at least a fourth stitch (15) in succession to a third stitch (13A) at one end of a binding area of a second knitted fabric of said pair of knitted fabrics;

(4) a process of transferring the fourth stitch (15) over the trick gap such that the fourth stitch (15) will cross with the second stitch (14);

(5) overlapping a fifth stitch (12B) of a wale interior to said first stitch (12A) at one end of the first knitted fabric with the stitch second (14);

(6) forming a sixth stitch (18) over the second and fifth stitches overlapped in step (5);

(7) transferring the sixth stitch (18) over the trick gap;

(8) overlapping a seventh stitch (13B) of a wale interior to said third stitch (13A) at one end of the second knitted fabric with the fourth stitch (15);

(9) forming an eighth stitch (19) over the fourth and seventh stitches; and

(10) transferring the eighth stitch (19) over the trick gap such that the eighth stitch (19) will cross with the sixth stitch (18).

3. A binding-off method as recited in claim 2, wherein in said overlapping step (5) the fifth stitch (12B) is transferred and overlapped with the second stitch (14), and in said overlapping step (8) the seventh stitch (13B) is transferred and overlapped with the second stitch (15).

4. A binding-off method as recited in claim 2, wherein in each of said forming steps (1) and (3) two stitches are formed, respectively.

* * * * *